United States Patent [19]

Stahlecker

[11] 4,105,265

[45] Aug. 8, 1978

[54] VIBRATION DAMPING BEARING ARRANGEMENT

[75] Inventor: Fritz Stahlecker, Überkingen, Germany

[73] Assignees: Fritz Stahlecker; Hans Stahlecker, both of Fed. Rep. of Germany

[21] Appl. No.: 676,160

[22] Filed: Apr. 12, 1976

[30] Foreign Application Priority Data

Apr. 11, 1975 [DE] Fed. Rep. of Germany ..... 2515783

[51] Int. Cl.[2] ..... F16C 13/00

[52] U.S. Cl. ..... 308/158; 308/26

[58] Field of Search ..... 308/184 R, 26, 176, 308/178, 179, DIG. 15, 158, 36, 121, 135

[56] References Cited

U.S. PATENT DOCUMENTS

| | | | |
|---|---|---|---|
| 3,494,678 | 2/1970 | Reznick et al. | 308/184 |
| 3,897,985 | 8/1975 | Davis et al. | 308/184 R |
| 4,021,086 | 5/1977 | Rajsigl | 309/DIG. 15 |

*Primary Examiner*—Richard A. Bertsch

*Attorney, Agent, or Firm*—Craig & Antonelli

[57] ABSTRACT

A vibration damping bearing arrangement for an open-end spinning turbine having a shaft urged axially against a thrust bearing and radially supported in a substantially V-shaped slot formed by pairs of guide rollers supported on a common bearing block. A vibration damping construction is provided for mounting the common bearing block at the spinning turbine with the step bearing being connected to the bearing block and supported thereby.

37 Claims, 2 Drawing Figures

VIBRATION DAMPING BEARING ARRANGEMENT

Figure 1:
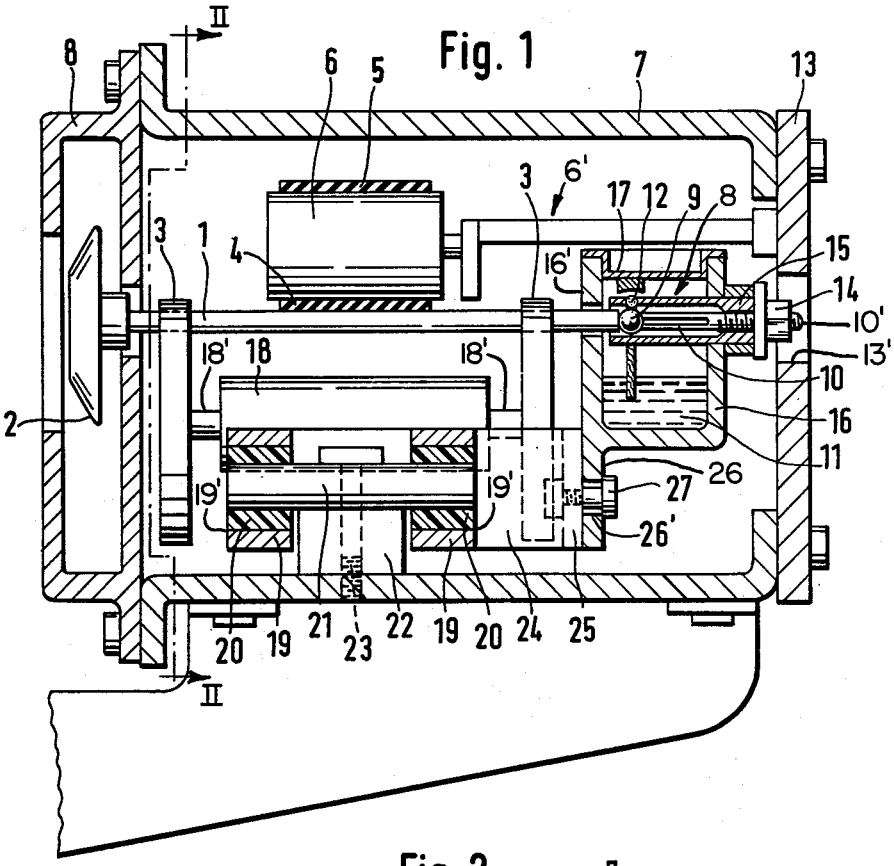

The present invention relates to a bearing arrangement and, more particularly, to a vibration damping bearing arrangement for an open-end spinning turbine, the shaft of which is pressed against a step of thrust bearing, which shaft is radially supported in a V-shaped slot formed by at least one pair of guide rollers disposed in a common bearing block.

It has been proposed in DOS No. 2,157,021 to radially support a shaft of each open-end spinning turbine in a V-shaped slot formed by two pairs of guide rollers. The open-end spinning turbine and/or the shaft thereof are stressed in the axial direction by an axial force which results in the end of the turbine shaft being pressed against a step or thrust bearing. In order to reduce noises of the drive mechanism or other elements of the spinning turbine which penetrate to the outside of the machine, the turbine shafts with their bearing and drive mechanisms are accommodated in this conventional construction in a continuous duct or chamber which extends in the longitudinal direction of the machine. If the provision is made in this conventional system to supply the step bearing with a lubricant, the bearing is ordinarily disposed in a housing which adjoins the chamber or duct with the housing also preferably being formed as a continuous duct or chamber extending in the longitudinal direction of the machine.

To even further reduce the noise passing to the outside of the machine, it has been proposed in the aforementioned type of structure to provide an elastic, vibration damping arrangement for a common bearing block supporting the guide roller bearings of the two pairs of guide rollers. Surprisingly, it has been found that, under practical conditions, this type of damping arrangement is disadvantageous in that it causes difficulties during the operation of the spinning turbine, resulting in a wear and tear of the various elements of the machine, as well as other damage in the area of the step bearing after a relatively brief period of operation. Specifically, by the proposed vibration damping construction, the guide roller and/or the turbine shaft execute relative motion with respect to the step bearing, thereby causing misalignment of the shaft and the step bearing. The misalignment of the shaft and step bearing during operation of the machine may, in some cases, cause temporary contact with a gasket of the step bearing, thereby causing undue wear at the step bearing and possibly at other elements of the open-end spinning turbine.

The aim underlying the present invention essentially resides in providing an improved vibration and noise damping construction for the guide roll bearings. For this purpose, provision is made in accordance with the present invention that the shaft of the open-end spinning turbine is supported radially in a V-shaped slot formed by guide roller pairs, the bearings of which are arranged in a common bearing support mounted on vibration supporting means connected to the thrust of step bearing.

According to one feature of the present invention, the common bearing block of the pairs of guide rollers is provided with a flange of extension portion which is fixably secured to a housing portion accommodating the thrust or step bearing. By virtue of this construction, the step bearing executes all movements together with the pairs of guide rollers, whereby any relative motion between the step bearing and guide rollers leading to an alignment error of the shaft and step bearing are eliminated.

According to yet another feature of the present invention, the common bearing support is fashioned so as to have two bifurcated ends through which bores are provided which extend in a direction parallel to the axis of the shaft with ring-shaped resilient vibration damping means being accommodated in the bores and with the bores at the respective ends accommodating mounting elements for mounting the common bearing support to a portion of the machine housing.

According to yet another feature of the present invention, the step bearing is detachably adjustably mounted in a housing with the housing being adjustable relative to the common bearing block.

Accordingly, it is an object of the present invention to provide a vibration damping bearing arrangement which avoids, by simple means, the afore-mentioned shortcomings and drawbacks encountered in the prior art.

Another object of the present invention resides in providing a vibration damping bearing construction for an open-end spinning turbine which extensively avoids undue wear and tear in the area of a thrust bearing.

A further object of the present invention resides in providing an improved vibration damping bearing construction for an open-end spinning turbine which assures a proper alignment of a shaft end of the turbine at a step bearing.

Still another object of the present invention resides in providing a vibration damping bearing construction for an open-end spinning turbine which can readily be installed and removed without any difficulties.

Yet another object of the present invention resides in providing a vibration damping bearing construction for an open-end spinning turbine which consists of a few, readily mountable components and which requires no complicated configuration, thereby rendering the respective components easy to manufacture.

Figure 2:
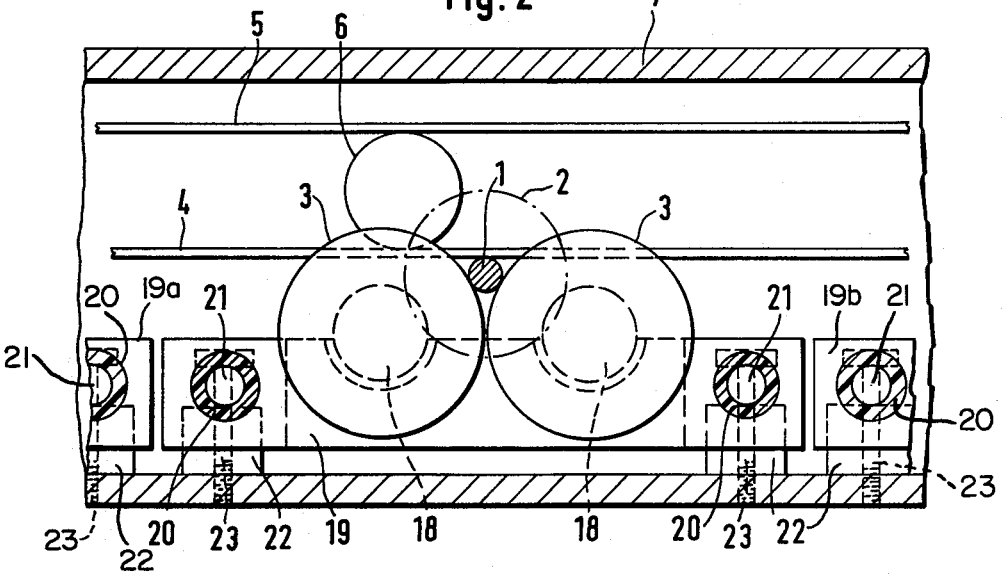

These and other objects, features and advantages of the present invention will become more apparent from the following description when taken in connection with the accompanying drawing, which shows, for the purposes of illustration only, one embodiment in accordance with the present invention, and wherein:

FIG. 1 is a cross-sectional side view of one open-end spinning turbine of a spinning unit provided with a vibration damping bearing arrangement in accordance with the present invention; and FIG. 2 is a cross-sectional view of the spinning unit taken along the line II–II of FIG. 1.

Referring now to the drawing, wherein like reference numerals are used in both views to designate like parts, and more particularly to FIG. 1, according to this figure, a shaft 1 of an open-end spinning turbine 2 of a spinning unit is supported in a radial direction in a V-shaped slot formed by two pairs of spaced guide rollers 3. The shaft 1 is pressed or urged into the V-shaped slot by a lower side 4 of a tangential belt which is under the pressure of a pressure roll 6. The top side 5 of the returning belt is guided in the return direction on the upper side of the pressure roll 6.

The shaft 1 of the open-end spinning turbine is stressed by an axial force oriented toward its free end or the end opposite the turbine 2. The axial force is created by a minor mutually oblique positioning of the guide roller pairs 3, by a slight inclined disposition of the shaft 1 with respect to the side 4 of the tangential belt and/or by pneumatic means (not shown) which produce a force in the axial direction.

The free end of the shaft 1 is supported on a step bearing generally designated by the reference character B which absorbs the axial force and effects a secure bearing of the open-end spinning turbine in the axial direction. The step bearing B may, for example, be of the type disclosed in my earlier-filed U.S. application Ser. No. 673521, filed Apr. 4, 1976, entitled "Shaft Bearing Arrangement" (based on German Application No. P 25 14 734.6), the disclosure of which is incorporated herein by reference to the extent necessary in understanding the present invention.

As shown in FIG. 1, the step bearing B includes a ball 9 supported in a freely rotatable manner by a holding member or fixture 10. The ball 9 is interposed between a free end of the shaft 1 and a free end of the holding member 10. The holding member 10 is fashioned as an oscillatable component and is fashioned, for example, as a slotted rod or pipe having, at its free end facing the ball 9, a socket for accommodating the ball with the socket preferably being of a spherically indented configuration. The other end of the holding member 10 is fixably clamped or secured in position. The oscillatable holding member 10 is excited to natural oscillations by vibrations of the spinning machine due to, for example, the rotation of the spinning turbine and/or the drive mechanism. By virtue of the excitation of the oscillatable holding member 10, the ball 9 is disposed relative to the end of the shaft 1 so that jamming or locking of the ball is avoided. Furthermore, the freely rotatably support of the ball 9 by the holding member 10 ensures a driving of the ball 9 by the shaft 1.

A wick 12, preferably of an impregnable material, is disposed so that a portion thereof rests on the ball 9 with another portion thereof being immersed in a lubricant bath 11, thereby providing, through the capillary effect, a lubrication between the ball 9, shaft 1, and the holding member 10.

The holding member 10 is surrounded by a tube 15 which extends beyond the area of the ball 9 with the diameter of the tube 15 being somewhat larger than the diameter of the ball 9. The tube 15 is provided with a slot or recess for accommodating a portion of the wick 12 and mounting the same in the area of the ball 9. The tube 15 may be flanged-over at its free end for the purpose of preventing the ball 9 from escaping the area of the holding member 10 even if, for some reason, the shaft 1 is removed from the tube 15.

The holding member 10 is secured within the tube 15 and the assembled holding member 10 and tube 15 are secured or clamped in position only at one end thereof. Preferably, the holding member 10 is suitably threadably inserted with an external thread in a thickened end of the tube 15 so that the holding member 10 can be axially adjusted with respect to the shaft 1.

To prevent displacement of the holding member 10 out of its adjusted position, a lock nut 14 is provided and threadably engages the portion of the holding member 10 which extends beyond the end of the tube 15. The tube 15 is fitted into a bore of a housing 16, which housing is sealed at the top thereof by a removable cover or lid 17 with the housing 16 accommodating a lubricant and forming the lubricant bath 11. The housing 16 includes a wall 16' having a bore of a somewhat larger diameter than the shaft 1 through which bore the shaft 1 is removably inserted up to the ball 9.

As shown in FIG. 2, a common bearing block 19 is provided for supporting bearings 18 of axles 18' of the pairs of guide rollers 3.

The bearing block 19 is bifurcated at two opposite ends so as to result in the formation of pairs of spaced extensions, each of which is provided with aligned bores 19' extending parallel to the longitudinal axis of the shaft 1.

Rings 20 of a resilient, vibration damping material, for example, "Vulkollan,"are disposed in the respective bores 19'. A pin 21 is attached to a support 22 arranged between the extensions of the bearing block 19 with the pins 21 being received in the rings 20. A screw 23 or other suitable fastening element secures the pin 21 to the support 22 and a portion of the spinning turbine housing 7 in such a manner that the bearing block 19 can execute minor oscillations within the range of elasticity imparted thereto by the rings 20.

To prevent the occurrence or relative motion between the shaft 1 and the bearing B in case of oscillations of the bearing block 19 and the related oscillations of the shaft 1 of the open-end spinning turbine 2, the bearing B is constructed so as to form a structural unit with the bearing block 19. For this purpose, as shown in FIG. 1, the bearing block 19 is provided with an extension 24 which projects in the longitudinal direction of the shaft 1 and which terminates in a mounting flange 25 which mates with a mounting flange 26 provided on the housing 16. Screws 27 or other conventional fastening elements are provided for securing the housing 16 to the common bearing block 19.

The flange 26 is provided with an elongated slot 26' which permits an exact adjustment of the shaft 1 relative to the bearing B so that the shaft 1 is in exact alignment with the ball 9 and holding member 10. The adjustment or alignment of the shaft 1, relative to the ball 9 and holding member 10, can readily be accomplished at a manufacturing plant, outside of an assembled machine, if the individual components of the bearing arrangement are combined into a single structural unit. In such a situation, once the shaft 1, ball 9 and holding member 10 are adjusted or set, if desired, the adjustment position may be secured by conventional securing means (not shown). By providing the elongated bore 26', it is possible to adjust the step bearing B so as to position the longitudinal axis of the holding member 10 with respect to the longitudinal axis of the shaft 1, thereby effecting an axial adjustment of the open-end spinning turbine 2.

The entire bearing arrangement of the present invention is accommodated in a duct or chamber formed by the housing 2, which may be fashioned as an extruded profile, with one side of the housing 7 being sealed by a cover or lid forming a turbine housing 8, while the other side of the housing 7 is sealed by a further lid 13 which, for example, can receive or mount the supporting arms generally designated by the reference numeral 6' for the pressure rolls 6. Furthermore, the lid 13 may be provided with a bore or aperture 13' through which the holding member 10, having a tool engaging surface 10', as well as the lock nut 14 are accessible from the outside of the housing, thereby permitting an exact axial adjustment of the holding member 10.

The duct or chamber of the housing 7 is continuous and extends over the entire length of a spinning unit so as to accommodate a plurality of spinning turbines arranged adjacent one another. As shown in FIG. 2, the common bearing blocks 19*a*, 19*b* for additional spinning turbines of a spinning unit are mounted at the housing 7 on respective sides of the bearing block 19.

While I have shown and described only one embodiment in accordance with the present invention, it is understood that the same is not limited thereto, but is susceptible of numerous changes and modifications as known to a person skilled in the art, and I therefor do not wish to be limited to the details shown and described herein, but intend to cover all such changes and modifications as are encompassed by the scope of the appended claims.

I claim:

1. A bearing arrangement for a shaft in an open-end spinning unit having an end axially urged against a bearing means, guide roller means for radially supporting the shaft, a bearing block means for rotatably supporting said guide roller means, and vibration damping supporting means for mounting said bearing block means at a relatively fixed element, characterized in that means are provided for connecting the bearing means with said bearing block means such that said bearing means is supported by said bearing block means, characterized in that the shaft is connected to a spinning turbine of the spinning unit.

2. An arrangement according to claim 1, characterized in that at least two pairs of guide rollers are provided for radially supporting the shaft, the pairs of guide rollers are arranged so as to form a substantially V-shaped slot for receiving the shaft, said bearing block means being fashioned as a common bearing block for rotatably supporting said at least two pairs of guide rollers.

3. An arrangement according to claim 2, characterized in that means are provided for adjustably mounting the bearing means relative to the end of the shaft.

4. An arrangement according to claim 2, characterized in that the bearing means includes a housing having a bore means therein for removably accommodating the end of the shaft, said housing forming a structural unit with said common bearing block.

5. An arrangement according to claim 4, characterized in that means are provided for detachably mounting said housing to said common bearing block.

6. An arrangement according to claim 4, characterized in that means are provided for adjustably mounting the bearing means relative to the end of the shaft.

7. An arrangement according to claim 6, characterized in that the bearing means further includes a ball means, an oscillatable holding means for freely rotatably holding said ball means in an abutting relationship with the end of the shaft, and means for fixably clamping only a first end of the oscillatable holding means to the housing.

8. An arrangement according to claim 7, characterized in that means are provided at a free end of said holding means of at least partially accommodating said ball means.

9. An arrangement according to claim 8, characterized in that said holding means includes a pin member having a longitudinal axis disposed in alignment with a longitudinal axis of the shaft.

10. An arrangement according to claim 9, characterized in that said pin member is provided with at least one longitudinal slot.

11. An arrangement according to claim 10, characterized in that said longitudinal slot extends from said accommodating means toward said clamping means along a predetermined length of said pin member.

12. An arrangement according to claim 11, characterized in that means are provided for retaining said ball means at said pin member when the shaft is removed.

13. An arrangement according to claim 12, characterized in that said retaining means includes a hollow tubular member surrounding at least the area of the accommodating means provided at the free end of said holding means.

14. An arrangement according to claim 13, characterized in that means are provided for lubricating said ball means.

15. An arrangement according to claim 14, characterized in that said retaining means further includes a flanged-over collar section provided at one end of said hollow tubular member for limiting the displacement of said ball means in said hollow tubular member.

16. An arrangement according to claim 7, characterized in that said ball means and said holding means form a single structural unit, and in that means are provided for axially adjusting the structural unit with respect to the end of the shaft.

17. An arrangement according to claim 16, characterized in that said bore means are provided in said common bearing block, said bore means extending substantially parallel to a longitudinal axis of the shaft, and in that the vibration damping supporting means includes annular rings of vibration damping material disposed in said bore means and in that pin means are connected to said common bearing block and are received in said bore means.

18. An arrangemment according to claim 17, characterized in that said common bearing block is bifurcated along two opposed edges thereof such that a pair of spaced extension portions are provided along each of the two edges, said bore means extending through each of said extension portions, and in that a common bearing block support means is disposed between each pair of extension portions, said pin means being disposed in an overlying relationship with respect to said common bearing block support means, and means are provided for securing the respective pin means and the common bearing block support means to the relatively fixed element.

19. An arrangement according to claim 17, characterized in that a housing means is provided for accommodating at least said pairs of guide rollers, said common bearing block and said bearing means, and in that means are provided in said housing means for permitting access to said bearings means.

20. An arrangement according to claim 19, characterized in that said housing means defines a continuous chamber in which are disposed a plurality of spinning turbines.

21. A bearing arrangement for a shaft having an end axially urged against a bearing means, guide roller means for radially supporting the shaft, a bearing block means for rotatably supporting said guide roller means, and vibration damping supporting means for mounting said bearing block means at a relatively fixed element, characterized in that means are provided for connecting the bearing means with said bearing block means such that said bearing means is supported by said bearing block means, characterized in that means are provided for detachably mounting said bearing means to said bearing block means.

22. A bearing arrangement for a shaft having an end axially urged against a bearing means, guide roller means for radially supporting the shaft, a bearing block means for rotatably supporting said guide roller means, and vibration damping supporting means for mounting said bearing block means at a relatively fixed element, characterized in that means are provided for connecting the bearings means with said bearing block means such that said bearing means is supported by said bearing block means, characterized in that the bearing means includes a ball means, an oscillatable holding means for freely rotatably holding said ball means in abutting relationship with the end of the shaft, and means for fixably clamping only a first end of the oscillatable holding means to the bearing means.

23. An arrangement according to claim 22, characterized in that means are provided at a free end of said holding means for at least partially accommodating said ball means.

24. An arrangement according to claim 23, characterized in that said holding means is a pin member having a longitudinal axis disposed in alignment with a longitudinal axis of the shaft.

25. An arrangement according to claim 24, characterized in that said pin member is provided with at least one longitudinal slot.

26. An arrangement according to claim 25, characterized in that said longitudinal slot extends from said accommodating means at the free end of said holding means toward said clamping means along a predetermined length of said pin member.

27. An arrangement according to claim 26, characterized in that means are provided for retaining said ball means at said pin member when the shaft is removed.

28. An arrangement according to claim 27, characterized in that said retaining means includes a hollow tubular member surrounding at least an area of said accommodating means provided at the free end of said holding means, the shaft being removably inserted into said hollow tubular member.

29. An arrangement according to claim 28, characterized in that means are provided for lubricating said ball means.

30. An arrangement according to claim 29, characterized in that said retaining means further includes a flanged-over collar section at one end of said hollow tubular member for limiting the displacement of said ball means in said hollow tubular member.

31. An arrangement according to claim 30, characterized in that means are provided for axially adjusting said holding means with respect to the end of the shaft.

32. An arrangement according to claim 31, characterized in that bore means are provided in said bearing block means, said bore means extending substantially parallel to a longitudinal axis of the shaft, and in that the vibration damping supporting means includes annular rings of vibration damping material disposed in said bore means, and in that pin means are connnected to said bearing block means and are received in said bore means.

33. An arrangement according to claim 32, characterized in that said bearing block means is bifurcated along two opposed edges thereof such that a pair of spaced extension portions are provided along each of the two edges, said bore means extending through each of said extensions portions, and in that support means for said bearing block means are disposed between each pair of extension portions, said pin means being disposed in an overlying relationship with respect to said support means for said bearing block means, and means are provided for securing the respective pin means and said support means for said bearing block means to the relatively fixed element.

34. An arrangement according to claim 33, characterized in that a housing means is provided for accommodating at least said pairs of guide rollers, said bearing block means and said bearing means, and in that means are provided in said housing means for permitting access to said bearing means.

35. A bearing arrangement for a shaft having an end axially urged against a bearing means, guide roller means for radially supporting the shaft, a bearing block means for rotatably supporting said guide roller means, and vibration damping supporting means for mounting said bearing block means at a relatively fixed element, characterized in that means are provided for connecting the bearing means with said bearing block means such that said bearing means is supported by said bearing block means, characterized in that bore means are provided in said bearing block means, said bore means extending substantially parallel to a longitudinal axis of the shaft, and in that the vibration damping supporting means includes annular rings of vibration damping material disposed in said bore means, and in that pin means are connected to said common bearing block and are received in said bore means.

36. A bearing arrangement for a shaft having an end axially urged against a bearing means, guide roller means for radially supporting the shaft, a bearing block means for rotatably supporting said guide roller means, and vibration damping supporting means for mounting said bearing block means at a relatively fixed element, characterized in that means are provided for connecting the bearing means with said bearing block means such that said bearing means is supported by said bearing block means, characterized in that a housing means is provided for accommodating at least said pairs of guide rollers, said bearing block means and said bearing means, and in that means are provided in said housing means for permitting access to said bearing means.

37. An arrangement according to claim 36, characterized in that said housing means defines a continuous chamber in which are disposed a plurality of individual spinning turbines.

* * * * *